United States Patent [19]

Topol et al.

[11] Patent Number: 4,531,114

[45] Date of Patent: Jul. 23, 1985

[54] INTELLIGENT FIRE SAFETY SYSTEM

[75] Inventors: Peter Topol, Tahoe City; Michael Slater, Palo Alto, both of Calif.

[73] Assignee: Safety Intelligence Systems, Reno, Nev.

[21] Appl. No.: 375,422

[22] Filed: May 6, 1982

[51] Int. Cl.[3] ..... G08B 1/08

[52] U.S. Cl. ..... 340/539; 340/531; 340/533; 340/506; 340/332; 340/628

[58] Field of Search ..... 340/539, 505, 506, 531, 340/533, 628, 525, 526, 825.06, 825.36, 825.54, 825.69, 825.72, 332, 519, 521, 692, 693, 286 R, 286 M; 179/5 R

[56] References Cited

U.S. PATENT DOCUMENTS

| | | | |
|---|---|---|---|
| 3,810,170 | 5/1974 | Zinsmeister | 340/331 |
| 4,023,146 | 5/1977 | Carroll | 340/519 |
| 4,074,225 | 2/1978 | Vandeweghe | 340/628 |
| 4,141,006 | 2/1979 | Braxton | 179/5 R |
| 4,347,499 | 8/1982 | Burkman, Sr. et al. | 340/332 |
| 4,367,458 | 1/1983 | Hackett | 340/539 |
| 4,392,125 | 7/1983 | Iwata | 340/505 |

*Primary Examiner*—Donnie L. Crosland
*Attorney, Agent, or Firm*—Townsend and Townsend

[57] ABSTRACT

An intelligent alarm system includes exit sign units having couplings to a smoke sensor and heat sensor for input information, a speech synthesizer and a strobe light to provide output information and a communication unit to provide communication coupling between exit sign units on a single floor and between interfloor interfaces and a central monitoring unit. The exit sign units provide at least two indications to the occupants. First a strobe light to flash at exits with sufficient intensity to draw attention to the exit and to penetrate smoke in a smoke filled hallway. Second, a speech synthesizer which provides verbal instructions to floor occupants according to the emergency situation. Each exit sign unit is operative independently of the central monitoring unit to set off a local alarm. The system is operative so that the central console unit must respond with a cancel command within a predetermined period of time to prevent the interfloor interface from communicating to all exit sign units under its supervision to set off a general floor alarm. Precise instructions may be formulated and verbalized through the speech synthesizers.

4 Claims, 4 Drawing Figures

INTELLIGENT FIRE SAFETY SYSTEM

BACKGROUND OF THE INVENTION

1. Field of Invention

This invention relates to a fire safety system for use in large, high occupancy buildings such as hotels and office buildings, and particularly this invention relates to a fire safety system for a multi-story building.

Advances in microelectronic technology have made it possible to include a considerable amount of data handling and processing capability at sites remote from a central processing unit. Moreover, advances have made it possible to economically synthesize speech, which capability can be used for giving precise audible instructions under machine control. There is a need to provide fire sensing, signal processing and precise alarm distribution in large, high occupancy buildings in the event of fire or other building emergencies. Centrally controlled systems are subject to breakdown and failure since so much of the information must be communicated to a central station for processing before alarms can be issued to instruct building occupants. This lack of guidance and reliance on central control to issue alarms has in the past and may in the future result in unnecessary injury and death because of human misinterpretation of alarm signals. What is needed is a fire alarm system which is capable of responding effectively to locally sensed emergency situations and of communicating precise instructions related to an the nature of emergency situation to building occupants as well as to a central station without required intervention of the central station.

2. Description of the Prior Art

Various centrally controlled alarm systems are known. For example one such alarm system is marketed under the Honeywell trademark by Minneapolis Honeywell of Minneapolis, Minn. Paging and intercom systems are also in use. However, the lack of adequate training for control personnel, the lack of adequate situation monitoring equipment and the lack of personnel availability at critical times limits the usefulness of such systems.

SUMMARY OF THE INVENTION

According to the invention, an intelligent alarm system includes exit sign units having couplings to a smoke sensor and heat sensor for input information, a speech synthesizer and a strobe light to provide output information and a communication unit to provide communication coupling between exit sign units on a single floor and between interfloor interfaces and a central monitoring unit. The exit sign units provide at least two indications to the occupants. First a strobe light to flash at exits with sufficient intensity to draw attention to the exit and to penetrate smoke in a smoke filled hallway. Second, a speech synthesizer which provides verbal instructions to floor occupants according to the emergency situation. Each exit sign unit is operative independently of the central monitoring unit to set off a local alarm. The system is operative so that the central console unit must respond with a cancel command within a predetermined period of time to prevent the interfloor interface from communicating to all exit sign units under its supervision to set off a general floor alarm. Precise instructions may be formulated and verbalized through the speech synthesizers. The invention will be better understood by reference to the following detailed description taken in connection with the accompanying drawings.

DESCRIPTION OF SPECIFIC EMBODIMENTS

Figure 1:
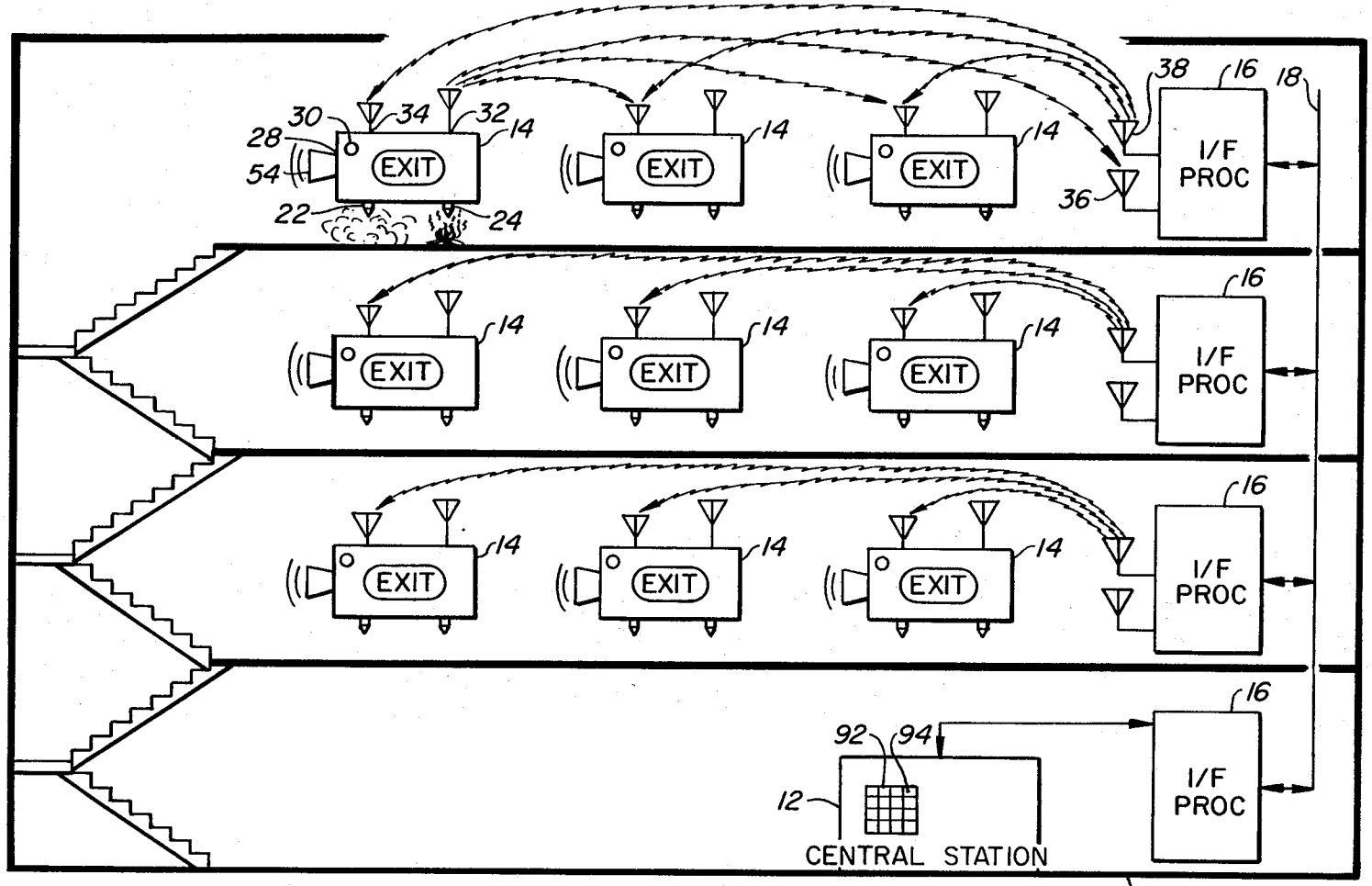
FIG. 1 is a block diagram of fire safety system according to the invention.

Referring to FIG. 1, there is shown an intelligent fire safety system 10 according to the invention comprising a central monitoring station 12, a plurality of exit sign units 14, a plurality of communication interface processor units 16 and interconnection means 18, all installed in a multi-wing or multi-story building 20. Each wing or story may be referred to as a cell.

The system 10 according to the invention is based on the concept of distributed autonomous decision making and directiives for fire safety functions. To this end, each exit sign unit 14 is equipped or is otherwise coupled to a smoke sensor 22 and a heat sensor 24. Each exit sign unit 14 is further equipped with a single preprogrammed microprocessor unit 26 (FIG. 2), a speech processor 28 (FIG. 2) and voice amplification system, and a strobe or flashing light 30. Still further, each exit sign unit 14 includes a radio transmitter 32 and radio receiver 34, the transmitter 32 having a range capable of communicating with all other exit sign units 14 on its assigned floor or within its assigned cell or wing.

Associated with each cell or floor is a communications interface unit 16. Each communications interface unit processor 16 includes a radio frequency receiver 36 and radio frequency transmitter 38 for communicating with the exit sign units 14 within its cell. In addition, each interface processor unit 16 also includes a pre-programmed microprocessor unit 40 (FIG. 3) which is assigned certain command and control functions as hereinafter explained. The interface processor units 16 are operative to communicate with one another through interconnection means 18. In new construction, the interconnection means may be an optical fiber with a fiber optic receiver 42 and a fiber optic transmitter 44 at each interface processor 16 to connect to the optical fiber 18. The optical fiber 18 links each interface processor 16 including an interface processor unit 16 connected with the central monitoring station 12.

In addition, the radio receivers 32, 36 and radio transmitters 34, 38 could be replaced with a fiber optic system in new construction where there is adequate space for wiring. In old construction, the interface processor units 16 may communicate with one another through radio frequency receivers and transmitters operative on different frequencies.

The communications protocol of the interface processor unit 16 is selected to provide duplex communication with all other interface processor units 16 and with each individual exit sign unit 14 within a local cell. Time division multiplexing and frequency division multiplexing may be used to minimize intracell and intercell radio interference.

Figure 2:
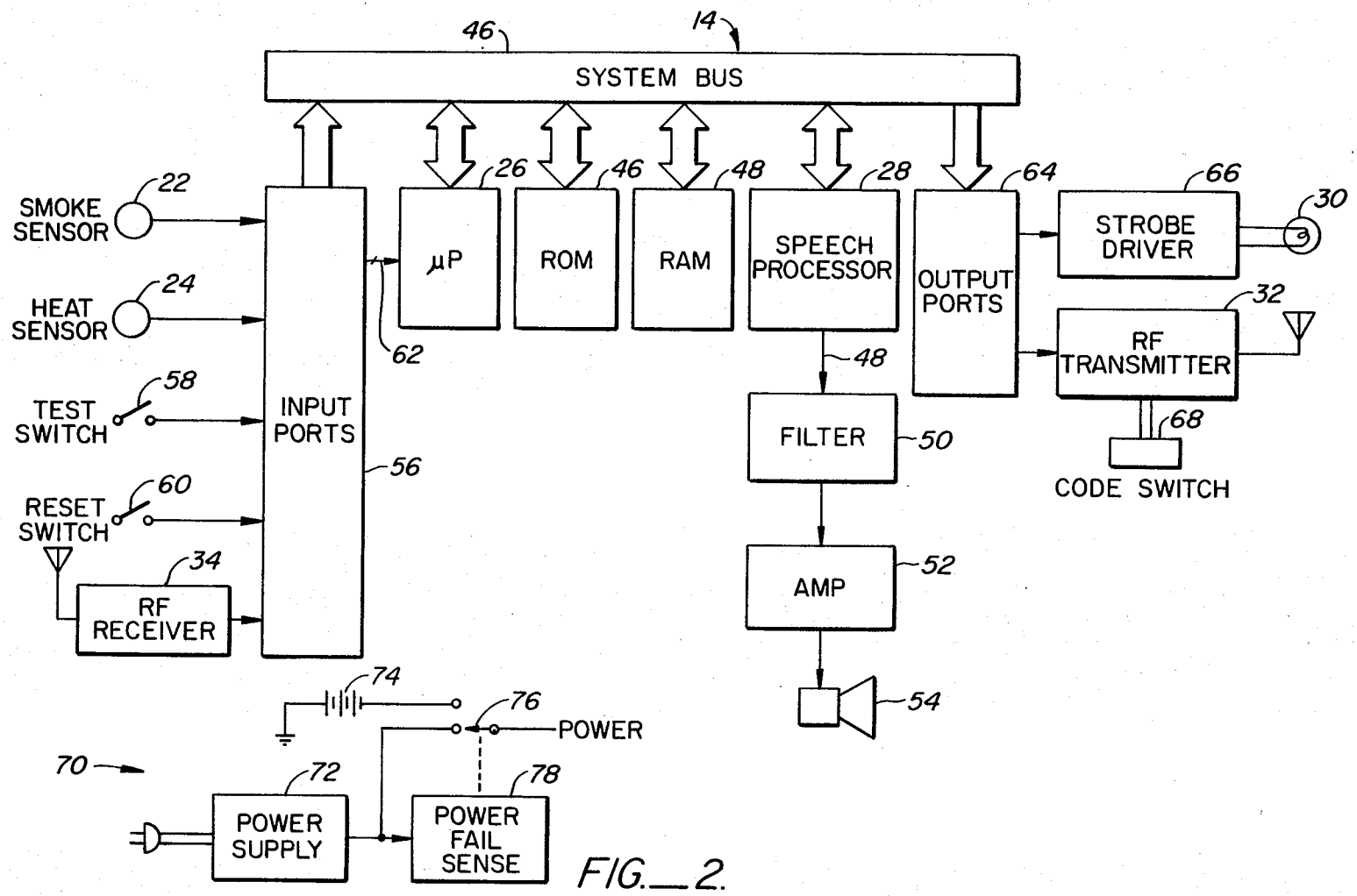
FIG. 2 is a block diagram of an exit sign unit according to the invention.

Referring to FIG. 2, there is shown a block diagram of an exit sign unit 14 according to the invention. The microprocessor unit 26, such as a Type 8048 microprocessor manufactured by Intel Corporation of Santa Clara, Calif. is coupled to a system data and control bus 46 in a conventional manner. A read only memory (ROM) 48 is preprogrammed with the process control functions of the exit sign unit 14 as hereinafter explained. The ROM 46 is coupled to the system bus 46. A random access memory (RAM) 48 is provided for temporary storage of data in process and for storage of the process control parameters defining the specific function of the exit sign unit 14. The RAM 48 is likewise coupled to the system bus 46. A speech processor 28, such as a Model TMS 5220 speech synthesizer manufactured by Texas Instruments, is coupled to the system bus 46. The speech processor 28 is preprogrammed with synthesized speech messages such as "Exit not safe". "Please go to other exit." "Attention! There is an emergency! Please come this way and proceed down the stairway to the lobby." "Proceed down the outside fire escape", or "Proceed up the stairs to the roof". The pattern of verbal instructions is selected according to the nature and pattern of the sensed emergency. A unit in which the heat sensor is set off should give directions away from the alarm site, for example. The speech processor 28 has an output 48 coupled through a filter 50 to an audio amplifier 52 which drives a loudspeaker 54 mounted in the exit sign.

Coupled to the system bus 46 are input ports 56 which provide the interface between a smoke sensor 22, heat sensor 24, the radio frequency receiver 34 and a test switch 58 and reset switch 60. The input ports 56 comprise primarily conventional analog-to-digital converters and storage registers (not shown) which can be addressed through the microprocessor unit 26 when polled following interrupt signals through interrupt lines 62.

Output ports 64 are coupled to the system bus 46 to provide an interface for the RF transmitter 32 and a strobe driver 66 for the strobe light 30. The output ports comprises primarily conventional storage registers coupled to digital-to-analog converters which provide signals to the output devices. A code switch 68 coupled to the RF transmitter 32 may be used to preset the identification code or unique frequency specifying the identity of the exit sign unit 14. Alternatively, the transmitter 32 and receiver 34 can be replaced by an intrasystem transmission line or multiwire bus coupled to the interface processor units 16.

A power supply 70 is provided for each interface processor unit 16 and exit sign unit 14. The power supply is a conventional AC to DC converter 72 with a battery backup 74 coupled through a relay 76 which is controlled by a power fail sense circuit 78. The relay 76 directs power to the power input terminals (not shown) of the various units of the system.

Figure 3:
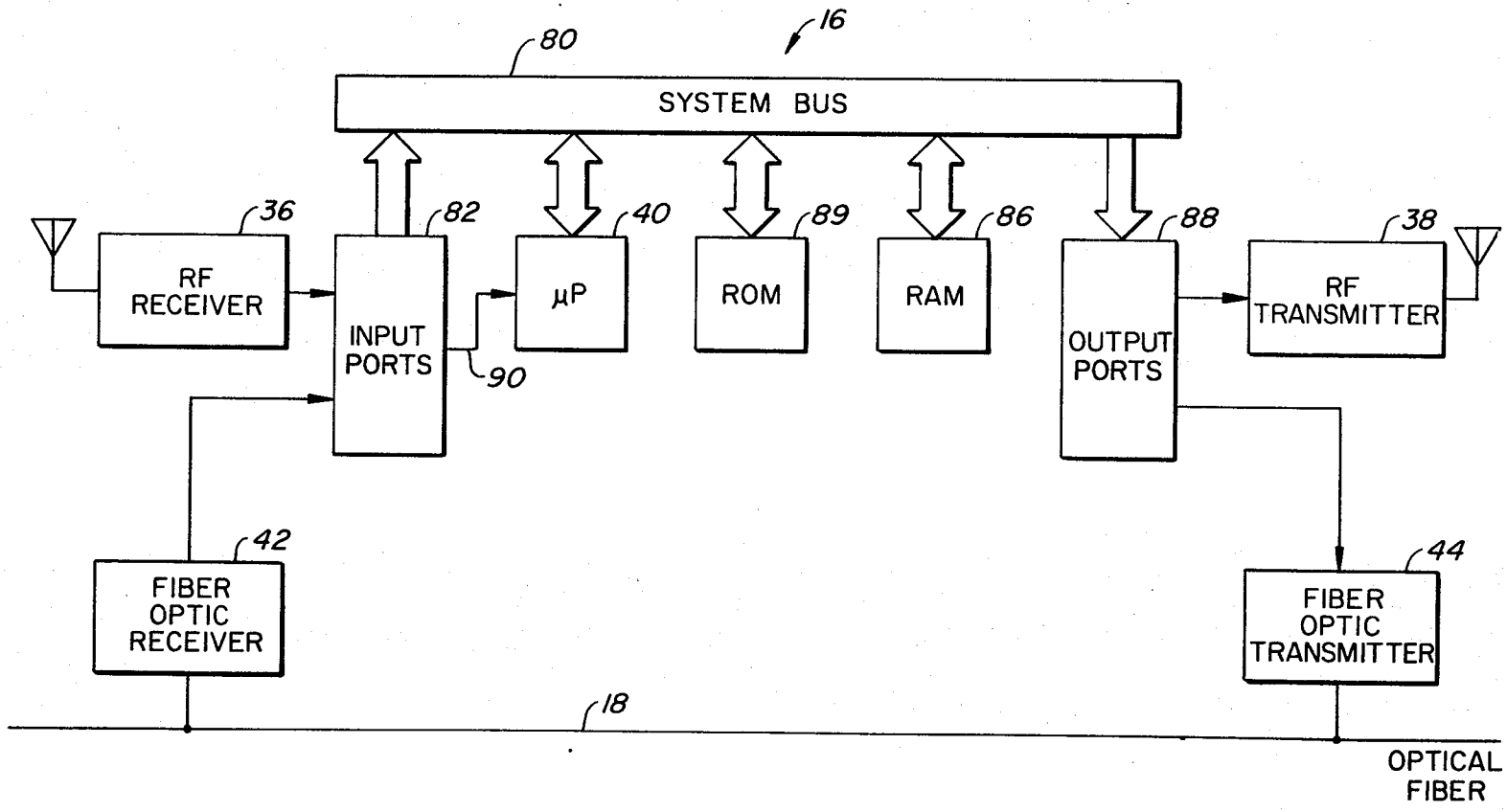
FIG. 3 is a block diagram of an interface processor unit according to the invention.

Turning to FIG. 3, there is shown an interface processor unit 16 according to the invention having receiver 36, transmitter 38, microprocessor unit 40, fiber optic receiver 42 and fiber optic transmitter 44 coupled to interconnection means 18. In addition, there is an interface processor unit system bus (comprising data and control lines) 80 to which is coupled the input ports 82 of the RF receiver 36 and fiber optic receiver 42. A read only memory 84 and random access memory 86 are also coupled to the system bus, as are output ports 88 for the RF transmitter 38 and fiber optic transmitter 44. The microprocessor 40 responds to interrupt signals to interrupt lines 90 from input ports 82 to respond to the input signals.

Figure 4:
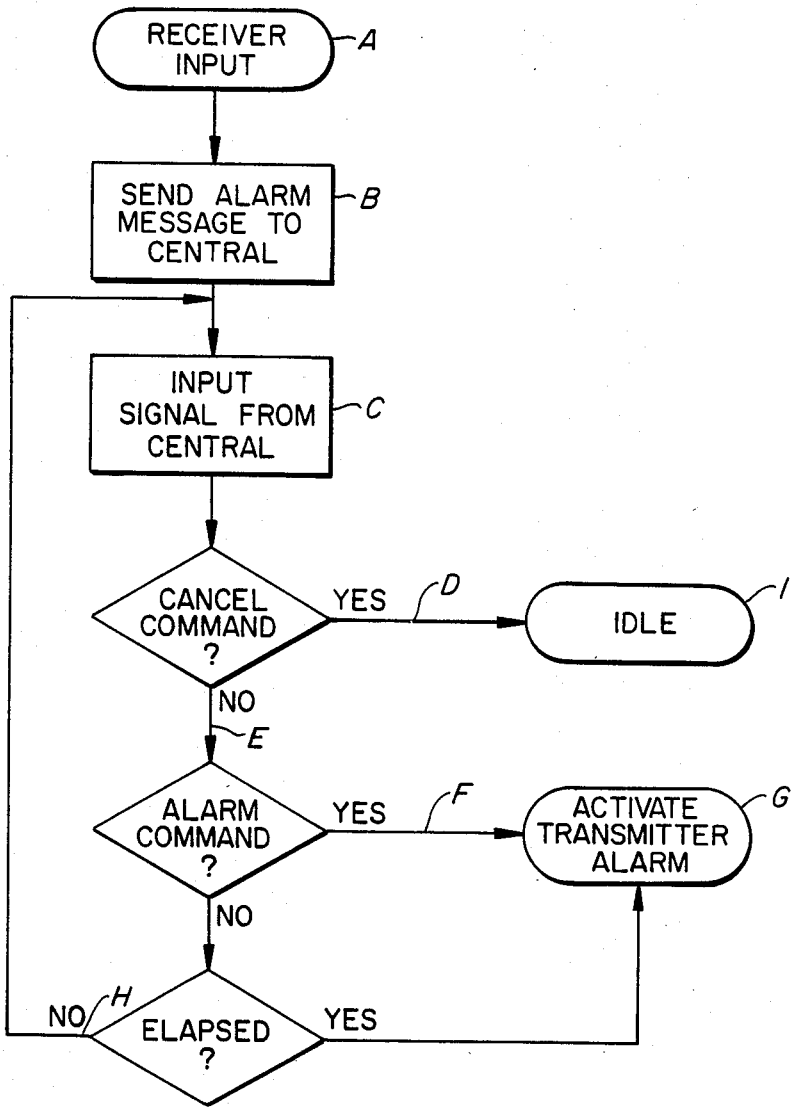
FIG. 4 is a flow chart of system operation according to the invention.

Turning to FIG. 4, there is shown a flow chart for the functions of both the interface processor unit 18 and exit sign unit 14. A unit initially receives input signals (Step A) which activates an alarm message to be sent to the local interface unit or central control (Step B). If the interface processor unit receives a message from an exit sign unit 14, the message is relayed to the interface processor unit 16 associated with the central monitoring station 12. The central monitoring station 12 includes a display 92 (FIG. 1) and cancel switch 94. The display 92 identifies the location of the alarm, and the cancel switch 94 is intended for use to override and cancel that alarm.

The exit sign units 14 and interface processor unit 16 look for input signals from the central monitoring unit (Step C). If a cancel command has been issued and received (Step D) the system returns to idle, and no alarm is issued. If no cancel command is received within a predetermined period of time, such as one minute (Step E), and if an emergency message has been issued and received (Step F), the unit transmitters are activated in a manner to alert all exit sign units 14 and interface processor units 16 according to the predetermined exit protocol established for the type of emergency message received (Step G). An immediate alarm command from the central monitoring unit bypasses and overrides the requirement of the predetermined wait time activating the transmitter alarm. Otherwise, the system recycles (Step H) until the idle state is entered (Step I).

This invention has numerous advantages. First, the intelligence or decision making capabilities of this fire alarm system is distributed among a number of autonomous and semi-autonomous devices, generally incorporated into exit sign units. These exit sign units are capable of responding with voice commands and instructions in response to the pattern of signals received from remote sensers, other control stations and a central monitoring unit. Alternatively, all remotely sensed information can be transmitted to an interface processor unit, which serves as a cellular control unit for controlling the command and instruction output of the exit sign units under its control.

The vocabulary of each voice-output exit sign unit may be customized to the assigned location. These and other advantages of the invention will be apparent from the foregoing specification.

The invention has now been explained with reference to specific embodiments. Other embodiments will be apparent to those of ordinary skill in the art. It is therefore not intended that this invention be limited, except as indicated by the appended claims.

We claim:

1. A fire alarm system comprising:

a plurality of exit sign units, each exit sign unit including a microprocessor and means including a synthesized voice output device coupled to the microprocessor for delivering a plurality of verbal messages to the vicinity of the corresponding exit sign in response to a preselected pattern of activating input signals;

at least one interface processor means, each said interface processor means including means for receiving and responding to a plurality of condition signals from different locations indicating at least the existence or non-existence of alarm conditions, said interface processor means being operative to couple together at least certain of the exit sign units to thereby cause a general alarm to be indicated in the vicinities of said certain exit sign units;

means for communicating condition signals and activating signals between said interface processor means and said exit sign units;

central monitoring means for manually overriding an alarm condition; and means for communicating among said interface processor means.

2. The apparatus according to claim 1 wherein said means for communicating between said interface processor means and said exit sign units comprise wireless transmitters and receivers.

3. The apparatus according to claim 1 or 2 wherein said means for communicating between said interface processor means comprises fiber optic cabling.

4. The apparatus according to claim 1 or 2 wherein said interface processor means includes a microprocessor.

* * * * *